US009793599B2

(12) United States Patent
Di Nallo et al.

(10) Patent No.: US 9,793,599 B2
(45) **Date of Patent: *Oct. 17, 2017**

(54) PORTABLE ELECTRONIC DEVICE WITH ANTENNA

(71) Applicant: Apple Inc., Cupertino, CA (US)

(72) Inventors: Carlo Di Nallo, San Carlos, CA (US); Erik G. de Jong, San Francisco, CA (US); Jayesh Nath, Milpitas, CA (US); Mattia Pascolini, San Francisco, CA (US); Tang Y. Tan, Palo Alto, CA (US); Yiren Wang, San Jose, CA (US); Zheyu Wang, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 331 days.

This patent is subject to a terminal disclaimer.

(21) Appl. No.: 14/640,902

(22) Filed: Mar. 6, 2015

(65) Prior Publication Data

US 2016/0261023 A1 Sep. 8, 2016

(51) Int. Cl.

| | |
|---|---|
| ***H01Q 1/24*** | (2006.01) |
| ***H01Q 9/42*** | (2006.01) |
| ***H01Q 5/321*** | (2015.01) |
| ***H01Q 5/328*** | (2015.01) |
| ***H01Q 5/335*** | (2015.01) |

(52) U.S. Cl.

CPC ..... *H01Q 1/243* (2013.01); *H01Q 5/321* (2015.01); *H01Q 5/328* (2015.01); *H01Q 5/335* (2015.01); *H01Q 9/42* (2013.01)

(58) Field of Classification Search

CPC ..... H01Q 1/243; H01Q 5/321; H01Q 5/328; H01Q 5/335; H01Q 9/42

USPC ..... 343/702

See application file for complete search history.

(56) References Cited

U.S. PATENT DOCUMENTS

| | | | |
|---|---|---|---|
| 5,173,055 | A | 12/1992 | Grabbe |
| 5,583,523 | A | 12/1996 | Wallace |
| 5,768,217 | A | 6/1998 | Sonoda et al. |
| 6,075,713 | A | 6/2000 | Lee et al. |
| 6,259,407 | B1 | 7/2001 | Tran |
| 6,765,540 | B2 | 7/2004 | Toncich |

(Continued)

FOREIGN PATENT DOCUMENTS

| | | |
|---|---|---|
| CN | 101682119 | 3/2010 |
| CN | 201533015 | 7/2010 |

(Continued)

*Primary Examiner* — Lam T Mai

(74) *Attorney, Agent, or Firm* — Treyz Law Group, P.C.; G. Victor Treyz; Michael H. Lyons

(57) ABSTRACT

An electronic device may have components mounted in a housing. The device may include wireless transceiver circuitry and antenna structures. A display may be mounted in the housing. The display may have a cover layer having an inner surface with a recess. The recess may run along a peripheral edge of the cover layer. An antenna structure such as an inverted-F antenna resonating element may be formed from a metal trace on a dielectric antenna carrier. The resonating element may be mounted in the recess without adhesive. Conductive vias may pass through the dielectric carrier. Metal members with dimples may be soldered to a flexible printed circuit and may be used to ground metal traces on the carrier and the flexible printed circuit to the housing when the carrier is attached to the housing with fasteners.

24 Claims, 12 Drawing Sheets

(56) References Cited

U.S. PATENT DOCUMENTS 6,825,751 B1 11/2004 Kita et al.
7,168,959 B2 1/2007 Kuo et al.
7,179,126 B2 2/2007 Chen
7,233,291 B2 6/2007 Elkobi et al.
7,321,335 B2 1/2008 Egorov
7,339,533 B2 3/2008 Kurashima et al.
7,506,436 B2 3/2009 Bachman
7,672,142 B2 3/2010 Wang et al.
7,688,267 B2 3/2010 Hill
7,705,795 B2 4/2010 Chiang et al.
7,722,398 B2 5/2010 Ma
7,724,530 B2 5/2010 Clayton et al.
7,750,857 B2 7/2010 Kim
7,808,434 B2 10/2010 White et al.
7,815,820 B2 10/2010 Tan et al.
7,876,274 B2 1/2011 Hobson et al.
7,889,139 B2 2/2011 Hobson et al.
8,050,313 B2 11/2011 Constantinidis et al.
8,169,374 B2 5/2012 Hill et al.
8,395,555 B2 3/2013 Hobson et al.
8,502,739 B2 8/2013 Ollikainen et al.
8,679,393 B1 3/2014 Willwerth et al.
8,766,858 B2 7/2014 Li et al.
8,780,581 B2 7/2014 Merz et al.
8,803,745 B2 8/2014 Dabov
9,186,828 B2 * 11/2015 Guterman ..... B29C 33/76
2004/0257283 A1 12/2004 Asano et al.
2006/0178116 A1 8/2006 Qi et al.
2008/0074329 A1 3/2008 Caballero et al.
2008/0150815 A1 6/2008 Nakahata et al.
2008/0316115 A1 12/2008 Hill et al.
2008/0316117 A1 12/2008 Hill et al.
2009/0065933 A1 3/2009 Takehara et al.
2009/0153410 A1 6/2009 Chiang et al.
2009/0174612 A1 7/2009 Ayala et al.
2009/0256759 A1 10/2009 Hill et al.
2009/0273523 A1 11/2009 Sakuma
2010/0123632 A1 5/2010 Hill et al.
2010/0193972 A1 8/2010 Yamamoto et al.
2010/0248799 A1 9/2010 Lum et al.
2010/0321255 A1 12/2010 Kough et al.
2011/0006953 A1 1/2011 Chiang et al.
2011/0156959 A1 6/2011 Chiu et al.
2011/0183721 A1 7/2011 Hill et al.
2011/0186324 A1 8/2011 Hur et al.
2011/0210825 A1 9/2011 Murakami et al.
2011/0222248 A1 9/2011 Sakai et al.
2011/0241949 A1 10/2011 Nickel et al.
2011/0250928 A1 10/2011 Schlub et al.
2011/0316751 A1 12/2011 Jarvis et al.
2012/0009983 A1 1/2012 Mow et al.
2012/0028679 A1 2/2012 Ozasa
2012/0059075 A1 3/2012 Prissok et al.
2012/0068893 A1 * 3/2012 Guterman ..... H01Q 1/2266
343/702
2012/0087065 A1 4/2012 Kim et al.
2012/0112969 A1 5/2012 Caballero et al.
2012/0133597 A1 5/2012 Chen
2012/0157175 A1 6/2012 Golko et al.
2012/0176278 A1 7/2012 Merz et al.
2012/0176279 A1 7/2012 Merz et al.
2012/0176754 A1 7/2012 Merz et al.
2012/0214412 A1 * 8/2012 Schlub ..... G01B 7/023
455/41.1
2012/0223865 A1 * 9/2012 Li ..... H01Q 9/42
343/702
2013/0044074 A1 2/2013 Park et al.
2013/0052947 A1 2/2013 Kole et al.
2013/0078917 A1 3/2013 Cho et al.
2013/0140965 A1 6/2013 Franklin et al.
2013/0194139 A1 8/2013 Nickel et al.
2013/0229362 A1 9/2013 Liu et al.
2013/0234910 A1 9/2013 Oh et al.
2013/0300618 A1 * 11/2013 Yarga ..... H01Q 1/243
343/720
2013/0321216 A1 12/2013 Jervis et al.
2014/0080411 A1 3/2014 Konanur et al.
2014/0112511 A1 * 4/2014 Corbin ..... H05K 9/006
381/333
2014/0132462 A1 5/2014 Ying
2014/0133074 A1 5/2014 Zahler et al.
2014/0170975 A1 6/2014 Liao
2014/0209691 A1 7/2014 Finn et al.
2014/0213178 A1 7/2014 Wolff et al.
2014/0218250 A1 8/2014 Kim et al.
2014/0226291 A1 8/2014 Gibbs et al.
2014/0232609 A1 * 8/2014 Lee ..... H01P 11/00
343/873
2015/0035709 A1 2/2015 Lim
2015/0207913 A1 7/2015 Nakano et al.
2015/0249485 A1 * 9/2015 Ouyang ..... H04B 5/0081
455/41.1
2015/0311960 A1 * 10/2015 Samardzija ..... G06F 1/163
455/90.3
2015/0351292 A1 * 12/2015 Chang ..... H01Q 1/526
361/749
2016/0056526 A1 * 2/2016 Li ..... H01Q 1/243
343/702

FOREIGN PATENT DOCUMENTS

CN 102394372 3/2012
EP 2109185 10/2009
EP 2302658 3/2011
EP 2474872 7/2012
EP 2869398 5/2015
KR 10/2012-0004338 1/2012
KR 10-2014-0024543 3/2014
WO 2009014366 1/2009
WO 2013149515 10/2013
WO 2013190119 12/2013

* cited by examiner

PORTABLE ELECTRONIC DEVICE WITH ANTENNA

BACKGROUND

This relates generally to electronic devices and, more particularly, to electronic devices with wireless communications circuitry.

Electronic devices often include wireless communications circuitry. Radio-frequency transceivers are coupled to antennas to support communications with external equipment. During operation, a radio-frequency transceiver uses an antenna to transmit and receive wireless signals.

It can be challenging to incorporate wireless components such as antenna structures within an electronic device. If care is not taken, an antenna may consume more space within a device than desired or may exhibit unsatisfactory wireless performance.

It would therefore be desirable to be able to provide improved antennas for electronic devices.

SUMMARY

An electronic device may be provided with electrical components mounted in a housing. The electrical components may include a wireless transceiver, an antenna, and other wireless circuitry.

A display may be mounted in the housing. The display may have a transparent layer such as display cover layer that is mounted to housing sidewalls. The display cover layer may have an inner surface with a recess. The recess may have the shape of a groove that runs along a peripheral edge of the display cover layer.

An antenna structure such as an inverted-F antenna resonating element may be formed from a metal trace on a dielectric antenna carrier. The metal trace and carrier may be mounted to the housing using fasteners that pass through openings in the carrier. A flexible printed circuit may be coupled to the antenna carrier. The carrier may be mounted to the housing using only the fasteners. When the carrier is attached to the housing, the resonating element is mounted within the recess without need for adhesive.

The housing may be a metal housing that forms an antenna ground. An inverted-F antenna may be formed from the resonating element in the recess and the metal housing serving as antenna ground. Metal members with dimples may be soldered to the flexible printed circuit to facilitate grounding of ground traces on the flexible printed circuit to the housing.

DETAILED DESCRIPTION

Figure 1:
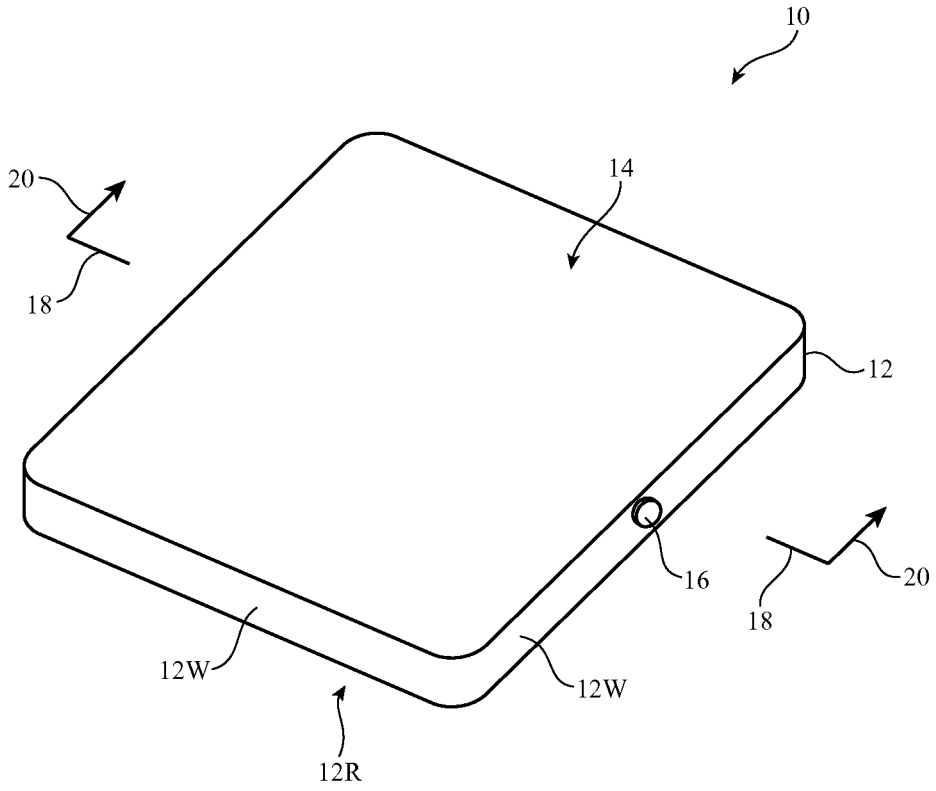
FIG. 1 is a perspective view of an illustrative electronic device with wireless communications circuitry in accordance with an embodiment.

An electronic device such as electronic device 10 of FIG. 1 may contain wireless circuitry. Device 10 may contain wireless communications circuitry that operates in long-range communications bands such as cellular telephone bands and wireless circuitry that operates in short-range communications bands such as the 2.4 GHz Bluetooth® band and the 2.4 GHz and 5 GHz WiFi® wireless local area network bands (sometimes referred to as IEEE 802.11 bands or wireless local area network communications bands). Device 10 may also contain wireless communications circuitry for implementing near-field communications, light-based wireless communications (e.g., infrared light communications and/or visible light communications), satellite navigation system communications, or other wireless communications. Illustrative configurations for the wireless circuitry of device 10 in which wireless communications are performed over a 2.4 GHz communications band and/or 5 GHz communications band (e.g., a Bluetooth® and/or WiFi® link) are sometimes described herein as an example.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, wristwatch device, or other portable computing device. Other configurations may be used for device 10 if desired. The example of FIG. 1 is merely illustrative.

In the example of FIG. 1, device 10 includes a display such as display 14 mounted in housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Device 10 may have opposing front and rear faces surrounded by sidewalls. Display 14 may have a planar or curved outer surface that forms the front face of device 10. The lower portion of housing 12, which may sometimes be referred to as rear housing wall 12R, may form the rear face of housing 12. Rear housing wall 12R may have a planar exterior surface (e.g., the rear of housing 12 may form a planar rear face for housing 12) or rear housing wall 12R may have a curved exterior surface or an exterior surface of other suitable shapes. Light-based components or other electrical components may be mounted in rear wall 12R or rear wall 12R may be free of components. Sidewalls 12W may have vertical exterior surfaces (e.g., surfaces that run vertically between display 14 and rear housing wall 12R), may have curved surfaces (e.g., surfaces that bow outwardly when viewed in cross section), may have beveled portions, may have profiles with straight and/or curved portions, or may have other suitable shapes. Device 10 may have a rectangular display and rectangular outline, may have a circular shape, or may have other suitable shapes.

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels or other light-emitting diodes, an array of electrowetting display pixels, or display pixels based on other display technologies.

Device 10 may include buttons such as button 16. There may be any suitable number of buttons in device 10 (e.g., a single button, more than one button, two or more buttons, five or more buttons, etc. Buttons may be located in openings in housing 12 or in an opening in a display (as examples). Buttons may be rotary buttons, sliding buttons, buttons that are actuated by pressing on a movable button member, etc. Button members for buttons such as button 16 may be formed from metal, glass, plastic, or other materials.

Figure 2:
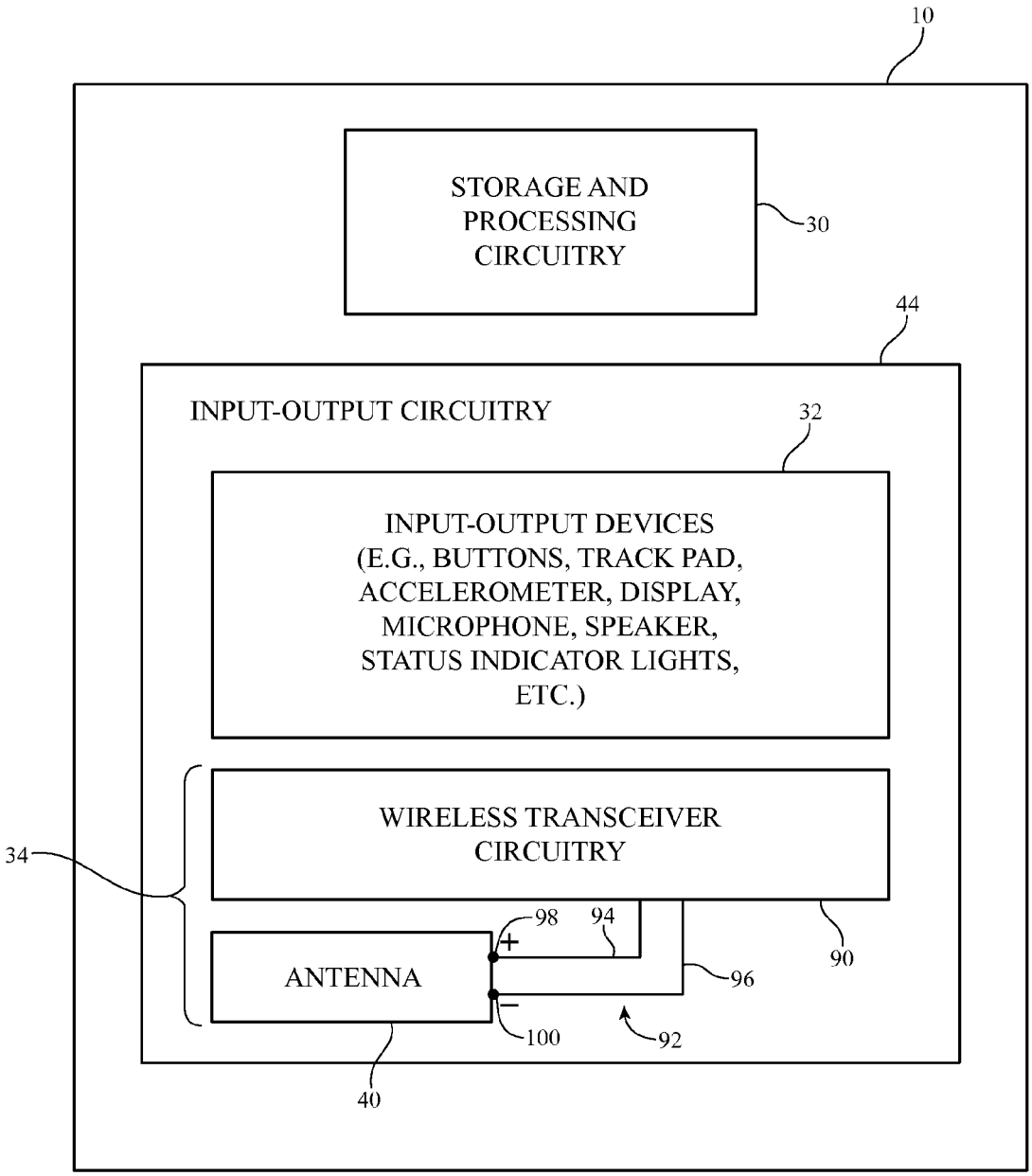
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include control circuitry such as storage and processing circuitry 30. Storage and processing circuitry 30 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 30 may be used to control the operation of device 10. This processing circuitry may be based on one or more microprocessors, microcontrollers, digital signal processors, baseband processor integrated circuits, application specific integrated circuits, etc.

Storage and processing circuitry 30 may be used to run software on device 10. For example, software running on device 10 may be used to process input commands from a user that are supplied using input-output components such as buttons, a touch screen such as display 14, force sensors (e.g., force sensors that are activated by pressing on display 14 or portions of display 14), accelerometers, light sensors, and other input-output circuitry. To support interactions with external equipment, storage and processing circuitry 30 may be used in implementing communications protocols. Communications protocols that may be implemented using storage and processing circuitry 30 include internet protocols, wireless local area network protocols (e.g., IEEE 802.11 protocols—sometimes referred to as WiFi®), protocols for other short-range wireless communications links such as the Bluetooth® protocol, etc.

Device 10 may include input-output circuitry 44. Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, force sensors, joysticks, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors (e.g., a capacitive proximity sensor and/or an infrared proximity sensor), magnetic sensors, and other sensors and input-output components.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include wireless local area network transceiver circuitry that may handle 2.4 GHz and 5 GHz bands for WiFi® (IEEE 802.11) communications, wireless transceiver circuitry that may handle the 2.4 GHz Bluetooth® communications band, cellular telephone transceiver circuitry for handling wireless communications in communications bands between 700 MHz and 2700 MHz or other suitable frequencies (as examples), or other wireless communications circuits. If desired, wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, satellite navigation system receiver circuitry, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles. To conserve power, it may be desirable in some embodiments to configure wireless communications circuitry 34 so that transceiver 90 handles exclusively short-range wireless links such as 2.4 GHz links and/or 5 GHz links (e.g., Bluetooth® and/or WiFi® links). Other configurations may be used for wireless circuitry 34 if desired (e.g., configurations with coverage in additional communications bands).

Wireless communications circuitry 34 may include one or more antennas such as antenna 40. Antenna 40 may be formed using any suitable antenna type. For example, antenna 40 may be an antenna with a resonating element that is formed from loop antenna structures, patch antenna structures, inverted-F antenna structures, slot antenna structures, planar inverted-F antenna structures, helical antenna structures, hybrids of these designs, etc.

Transmission line paths such as transmission line 92 may be used to couple antenna 40 to transceiver circuitry 90. Transmission line 92 may be coupled to antenna feed structures associated with antenna structures 40. As an example, antenna structures 40 may form an inverted-F antenna or other type of antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. The illustrative feeding configuration of FIG. 2 is merely illustrative.

Transmission line 92 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within the transmission lines, if desired. Circuits for impedance matching circuitry may be formed from discrete components (e.g., surface mount technology components) or may be formed from housing structures, printed circuit board structures, traces on plastic supports, etc. Components such as these may also be used in forming filter circuitry.

Figure 3:
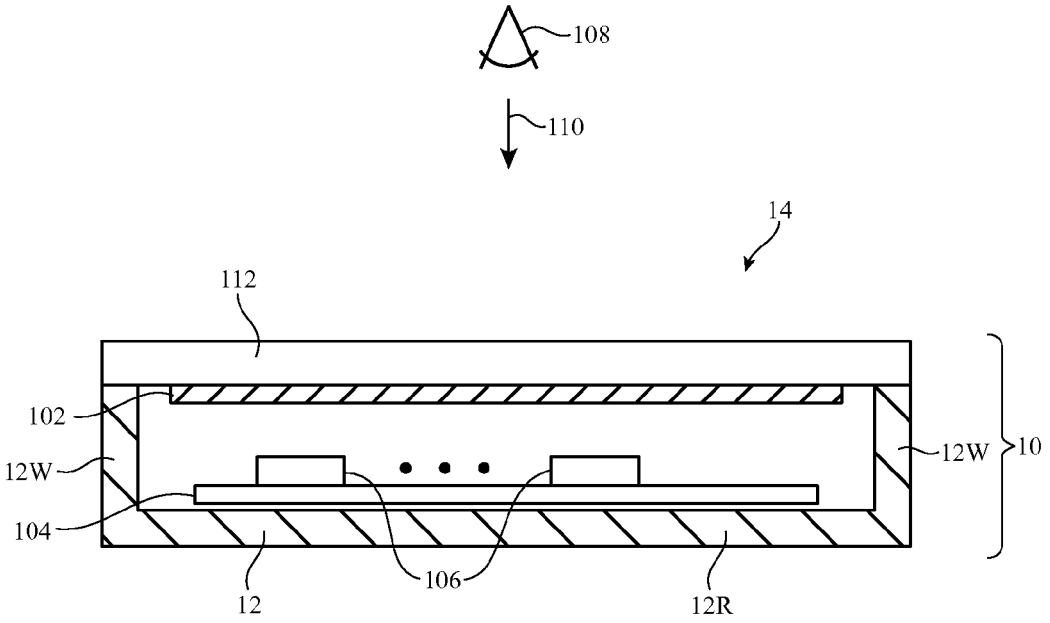
FIG. 3 is a cross-sectional side view of an illustrative electronic device with a planar display in accordance with an embodiment.

Electrical components for forming circuitry such as storage and processing circuitry 30 and input-output circuitry 44 of FIG. 2 may be mounted in housing 12. Consider, as an example, the cross-sectional side view of device 10 of FIG. 3. FIG. 3 is a cross-sectional side view of a device such as device 10 of FIG. 1 taken along line 18 and viewed in direction 20. As shown in FIG. 3, display 14 of device 10 may be formed from a display module such as display module 102 (sometimes referred to as a display) mounted under a cover layer such as display cover layer 112 (as an example). Display 14 (display module 102) may be a liquid crystal display, an organic light-emitting diode display, a plasma display, an electrophoretic display, a display that is insensitive to touch, a touch sensitive display that incorporates and array of capacitive touch sensor electrodes or other touch sensor structures, or may be any other type of suitable display. Display cover layer 112 may be layer of clear glass, a transparent plastic member, a transparent crystalline member such as a sapphire layer, a ceramic, fused silica, a transparent layer formed from one or more different types of materials, or other clear structure. Layer 112 may form the front face of device 10. If desired, the outermost layer of display 14 (e.g., display layer 112) may be used as a substrate for an array of color filter elements (i.e., layer 112 may be a color filter layer), as a substrate for thin-film transistor circuitry (i.e., layer 112 may be a thin-film transistor layer), or may be a substrate that includes both thin-film transistor circuitry and color filter circuitry (as examples).

Device 10 may have inner housing structures that provide structural support to device 10 and/or that serve as mounting platforms for printed circuits and other structures. Structural internal housing members may sometimes be referred to as housing structures and may be considered to form part of housing 12.

Electrical components 106 for forming circuitry such as circuitry 30 and 44 may be mounted within the interior of housing 12. Components 106 may be mounted to printed circuits such as printed circuit 104. Printed circuit 104 may be a rigid printed circuit board (e.g., a printed circuit board formed from fiberglass-filled epoxy or other rigid printed circuit board material) or may be a flexible printed circuit (e.g., printed circuit formed from a sheet of polyimide or other flexible polymer layer). Patterned metal traces within printed circuit board 104 may be used to form signal paths between components 106. If desired, components such as connectors may be mounted to printed circuit 104. Cables such as one or more flexible printed circuit cables may have mating connectors and may couple circuitry on printed circuits such as printed circuit 104 to display 102, to antenna(s) 40 (FIG. 2), etc. Flexible printed circuit cables may also be mounted to boards such as board 104 using solder or other conductive material.

The outermost layer of display 14 such as display cover layer 112 is preferably a transparent display layer that is formed from transparent structures that allow light from display 102 to pass through layer 112. This allows images on display 102 to be viewed by viewer 108 in direction 110 during operation of device 10.

Figure 4:
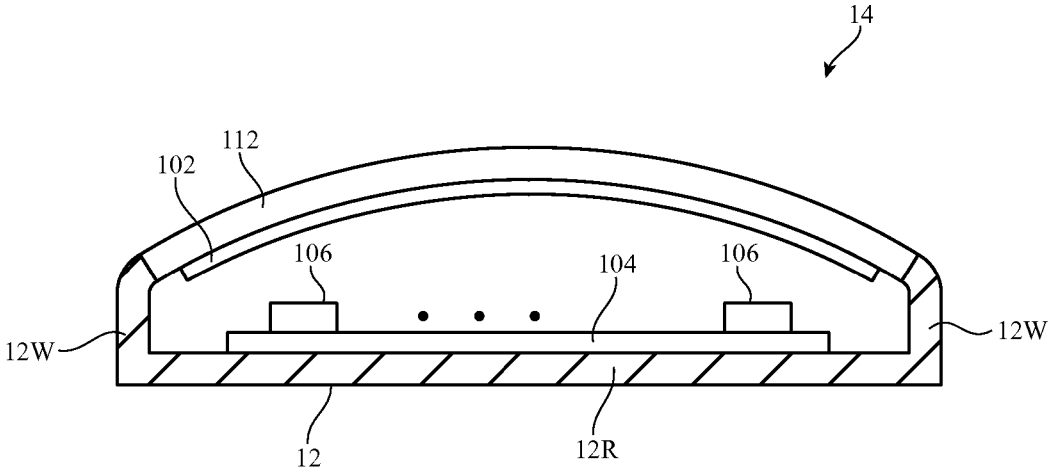
FIG. 4 is cross-sectional side view of an illustrative electronic device with a curved display in accordance with an embodiment.

In the example of FIG. 3, transparent display cover layer 112 has planar inner and outer surfaces. If desired, one or more of the surfaces of display 14 may be curved (e.g., concave, convex, etc.). As shown in the illustrative cross-sectional side view of FIG. 4, for example, display 14 may have a convex outer surface. In this type of configuration, display cover layer 112 may have a planar inner surface or a curved inner surface (as shown in FIG. 4).

Figure 5:
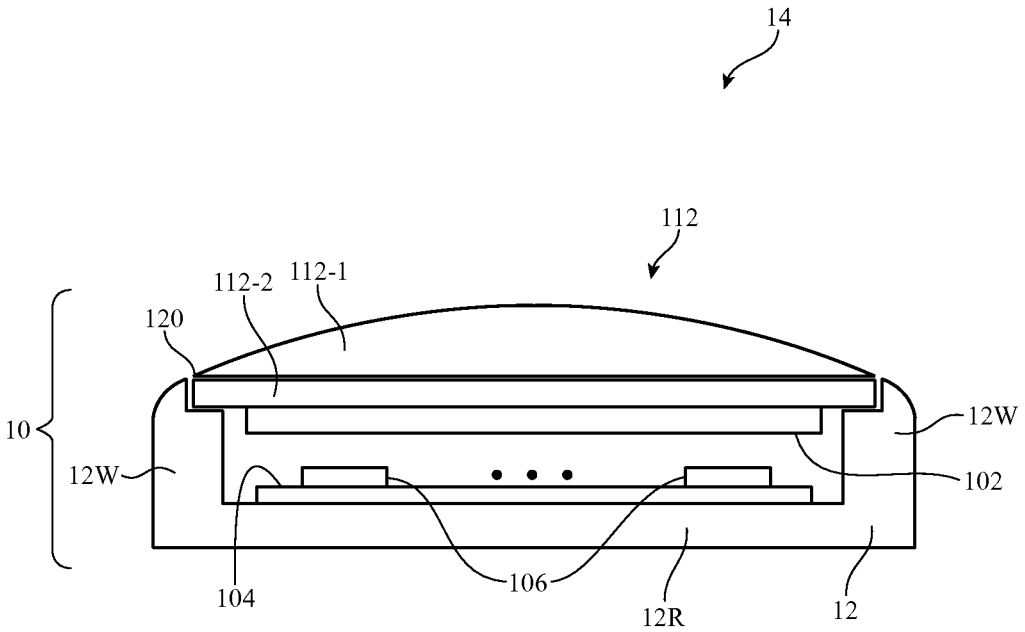
FIG. 5 is a cross-sectional side view of an illustrative electronic device with a display having a curved layer mounted to a planar layer in accordance with an embodiment.

As shown in FIG. 5, display cover layer 112 may have more than one layer. In the FIG. 5 example, display cover layer 112 has an outer layer such as layer 112-1 and an inner layer such as layer 112-2. Layer 112-1 may have a convex outer surface and a planar inner surface (as an example). Layer 112-2 may have opposing planar outer and inner surfaces (as an example). Adhesive 120 (e.g., optically clear adhesive) may be used to attach layers 112-1 and 112-2 together. Display structure 102 (e.g., an organic light-emitting diode display or other display module) may be mounted to the interior surface of lower layer 112-2 (e.g., a planar inner surface) using adhesive or other attachment mechanisms.

Figure 6:
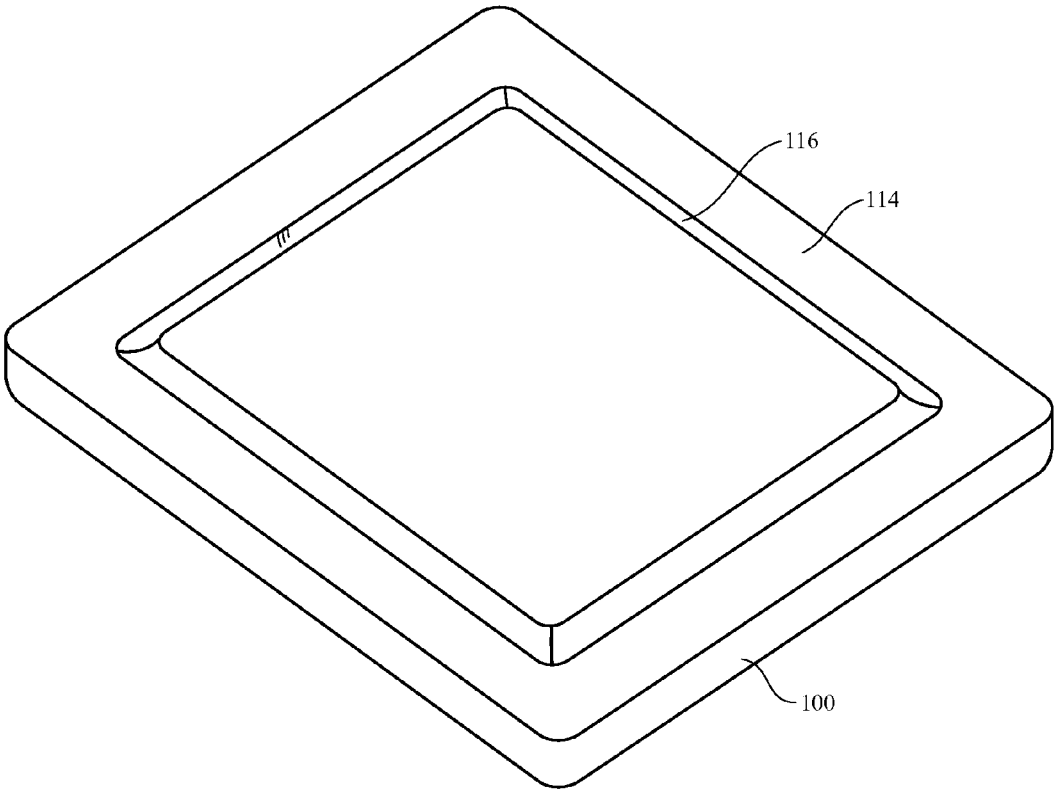
FIG. 6 is a perspective view of an illustrative display layer showing how the interior surface of the display layer may be provided with a recess such as a peripheral groove in accordance with an embodiment.

It may be desirable to create recesses in structures such as housing 12 and/or display 14 to accommodate antenna structures. As an example, a recess such as groove 116 of FIG. 6 may be formed in inner surface 114 of a dielectric layer such as display cover layer 112. Groove 116 may run along one or more peripheral edges of display cover layer 112. In the FIG. 6 example, display cover layer 112 has a rectangular shape and four peripheral edges. Groove 116 runs along all four peripheral edges of display cover layer 112. Configurations in which recesses such as groove 116 of FIG. 6 have other shapes may also be used, if desired (e.g., configurations in which recess 116 runs along a single edge of display cover layer 112, configurations in which recess 116 runs along two edges of display cover layer 112, configurations in which recess 116 runs along three edges of display cover layer 112, etc.). If desired, display 14 may be circular and recess 116 may form a circular or semicircular groove that runs along the curved edges of display 14 (e.g., recess 116 may be a circular groove or may form a groove that has a curved shape that runs along part of a curved peripheral edge in display 14). Recesses such as groove 116 may be formed by machining, etching, molding, water jet cutting, abrasion using fine particles of grit, or other fabrication techniques. The cross-sectional shape of groove 116 may be square, rectangular, or semicircular, may have curved shapes, may have shapes with straight sides and/or curved sides, etc.

One or more antennas for device 10 may be formed from an antenna resonating element that is fully or partly mounted in a recess such as recess 116. In the illustrative configuration of FIG. 7, antenna 40 is an inverted-F antenna that has an antenna resonating element located within recess 116. Inverted-F antenna 40 of FIG. 7 has antenna resonating element 122 and antenna ground (ground plane) 124. Antenna ground 124 may be formed from a metal housing structure (e.g., housing 12 in a configuration in which some or all of housing 12 is metal), may be formed from conductive traces on a printed circuit board, may be formed from ground structures in other devices (e.g., display 102), and/or may be implemented using other suitable ground structures. Antenna resonating element 122 may have a main resonating element arm such as arm 120. The length of arm 120 (which is sometimes referred to as a resonating element arm or resonating element) may be selected so that antenna 40 resonates at desired operating frequencies. For example, the length of arm 120 may be a quarter of a wavelength at a desired operating frequency for antenna 40. Antenna 40 may also exhibit resonances at harmonic frequencies.

Arm 120 may be formed from metal traces on an antenna support. The antenna support may be, for example, a polymer (plastic) antenna carrier or other dielectric member. Metal trace 120 may be coupled to ground 124 by return path 126. Return path 126 may be formed from a metal trace on the antenna carrier or may be formed from other conductive structures. Antenna feed 128 may include positive antenna feed terminal 98 and ground antenna feed terminal 100 and may be coupled parallel to return path 126 between the metal trace of resonating element arm 120 and ground 124. If desired, inverted-F antennas such as illustrative antenna 40 of FIG. 7 may have more than one resonating arm branch (e.g., to create multiple frequency resonances to support operations in multiple communications bands) or may have other antenna structures (e.g., parasitic antenna resonating elements, tunable components to support antenna tuning, etc.). For example, one end of arm 120 may form a high-band branch that resonates at 5 GHz and another end of arm 120 may form a low-band branch that resonates at 2.4 GHz.

Figure 7:
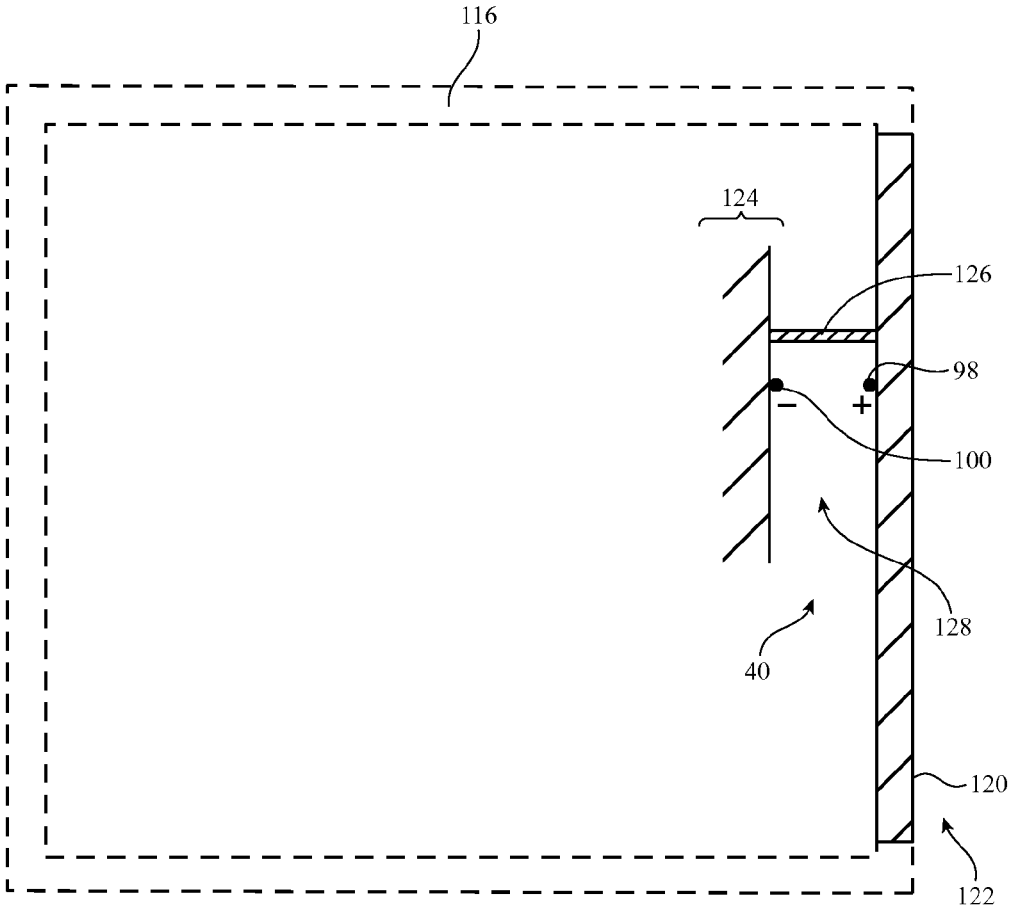
FIG. 7 is a top view of an illustrative antenna of the type that may have an antenna resonating element mounted within a display groove in accordance with an embodiment.

The bandwidth of antennas such as antenna 40 of FIG. 7 may be affected by the separation between ground 124 and antenna resonating element 122 (i.e., the distance between metal trace 120 and housing 12 in a configuration in which ground 124 is formed from housing 12). By providing recesses such as recess 116 in display cover layer 112, the distance between ground 124 and antenna resonating element 120 can be enhanced without overly increasing the size of device 10 and housing 12.

Figure 8:
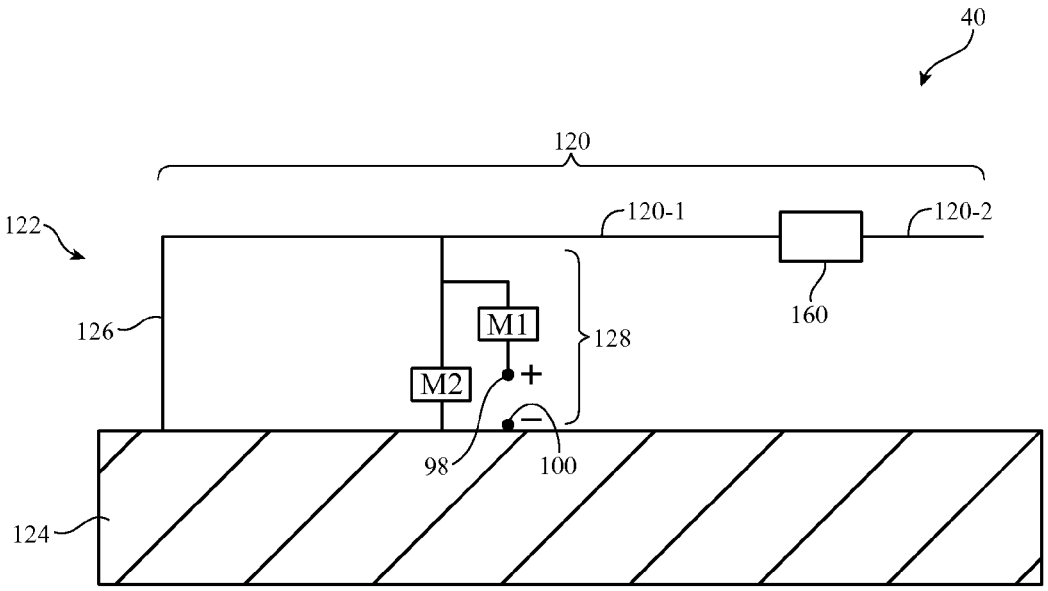
FIG. 8 is schematic diagram of an illustrative inverted-F antenna with impedance matching circuits in accordance with an embodiment.

If desired, circuit components may be interposed in the antenna feed and/or portions of antenna 40. As an example, antenna 40 may be an inverted-F antenna of the type shown in FIG. 8. As shown in FIG. 8, antenna 40 may include an electrical component such as component 160. Component 160 may be an inductor or other circuit element. Component 160 may be formed within antenna resonating element arm 120 (e.g., component 160 may be interposed between portions 120-1 and 120-2 of arm 120). The value of component 160 (e.g., the inductance value for component 160) may be selected to adjust the effective length of arm 120 and thereby adjust the frequency response of antenna 40. Component 160 may be a packaged discrete inductor such as an inductor packaged in a surface mount technology package or other package.

If desired, impedance matching circuits such as impedance matching circuits M1 and M2 may be coupled to feed 128. For example, matching circuit M1 may be coupled between arm 120 and ground 124 in parallel with terminals 98 and 100 and matching circuit M2 may be coupled in series between positive feed terminal 98 and arm 120. Other types of impedance matching circuitry, filter circuitry, antenna tuning circuits, and other antenna circuitry may be used in antenna 40 and feed 128 if desired. The configuration of FIG. 8 is merely illustrative.

Figure 9:
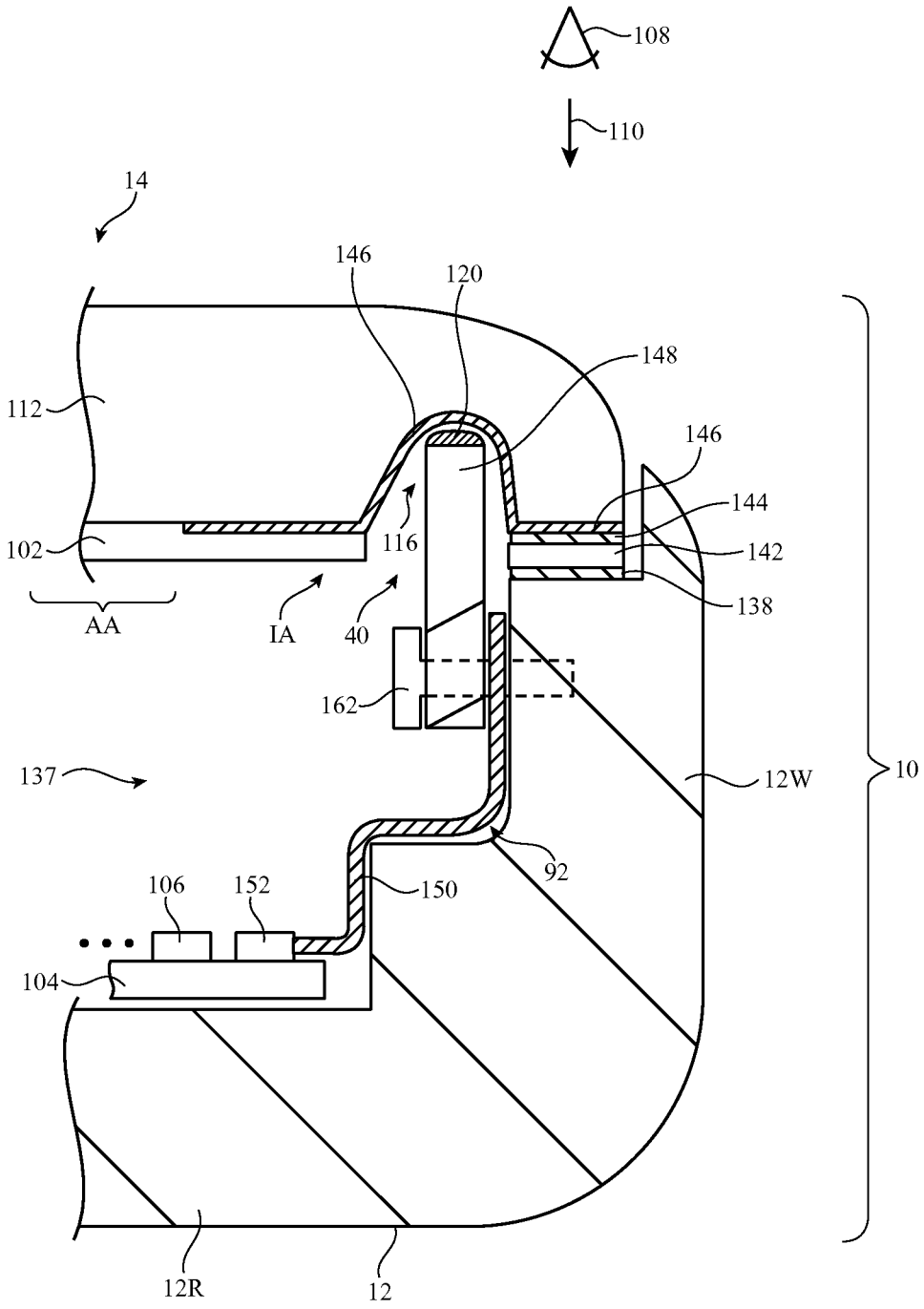
FIG. 9 is a cross-sectional side view of a portion of an electronic device structure having a recess such as a peripheral groove in which an antenna resonating element has been mounted in accordance with an embodiment.

A cross-sectional side view of antenna 40 taken through an edge portion of device 10 is shown in FIG. 9. As shown in FIG. 9, display 14 may include display cover layer 112 and display module (display) 102. Active area AA of display module 102 may have an array of pixels (e.g., organic light-emitting diode pixels in a configuration in which display module 102 is an organic-light-emitting diode display, liquid crystal display pixels, electrophoretic display pixels, etc.) for displaying images. Inactive display border area IA may form a ring that runs around the periphery of display 14 (e.g., a rectangular ring in configurations in which display 14 has a rectangular shape, a circular ring in configuration in which display 14 is circular, etc.).

A near-field communications loop antenna may be formed under display 102. The near-field communications loop antenna may be formed from metal traces on a printed circuit substrate or other near-field communications antenna structures.

Components may be mounted in the interior of device 10 in a region such as region 137. For example, a component such as an electromechanical actuator (e.g., a haptic feedback device, a piezoelectric actuator, a solenoid, a vibrator for issuing alerts, a device for imparting other vibrations or motions to device 10, etc.) or other suitable electrical component(s) may be mounted in region 137.

Antenna resonating element arm 120 of antenna 40 may be formed from metal traces on a dielectric carrier such as dielectric antenna carrier 148. Carrier 148 may be a single unitary plastic member that is mounted within device 10 using fasteners without using adhesive or springs (as an example). Metal traces for antenna 40 may be formed on carrier 148 using laser direct structuring (e.g., a process in which portions of carrier 148 are selectively activated for metal plating using laser light) or other suitable metal trace patterning techniques.

Antenna 40 may be coupled to electrical components 106 on printed circuit 104 using a transmission line formed on flexible printed circuit 150 or other suitable signal path. Matching circuit components such as matching circuits M1 and M2 of FIG. 8 may be mounted on flexible printed circuit 150 (e.g., using solder). Connector 152 may be used to couple flexible printed circuit 150 to printed circuit 104.

Antenna 40 may be formed from an antenna resonating element such as antenna resonating element 122 and antenna ground 124 of FIGS. 7 and 8. Antenna ground 124 may be formed from conductive structures in device 10 such as portions of housing 12 (e.g., metal housing 12) and ground structures on carrier 148 and flexible printed circuit 150.

Fasteners 162 may be used to mount carrier 148 to housing 12. Fasteners 162 may be formed from a conductive material such as metal to help form a conductive path between metal traces on carrier 148 and metal housing 12. Fasteners 162 may be threaded metal fasteners such as screws or other suitable structures for mounting carrier 148 to housing 12. One or more fasteners 162 may be used to secure carrier 148 to housing 12. For example, two threaded screws may be received within two corresponding threaded holes in housing 12 to screw carrier 148 against housing 12. Flexible printed circuit 150 may, if desired, have a portion that is interposed between carrier 148 and housing 12. With this type of arrangement, carrier 148 and flexible printed circuit 150 may each have a pair of holes to accommodate fasteners 162.

To hide internal device components from view in direction 110 by user 108, peripheral portions of the inner surface of display cover layer 112 may be coated with a layer of opaque masking material. For example, portions of display cover layer 112 that overlap inactive border region IA of display 102 may be covered with opaque masking layer 146. Layer 146 may cover groove 116 and portions of housing 12 up to the outermost edge of display cover layer 112 (as an example). Opaque masking layer 146 may be formed from black ink, white ink, polymers that are black, white, or have other colors, metals, etc.

As shown in FIG. 9, structure 142 may be interposed between the outer portion of display cover layer 112 and housing 12. Adhesive or other attachment mechanisms may be used in mounting structure 142 in device 10 (see, e.g., adhesive layer 138 and adhesive layer 144). Adhesive such as layers 138 and 144 and/or other fastening mechanisms may be used to attach display cover layer 12 to sidewalls 12W of housing 12. Structure 142 may be a gasket, a force sensor that is used to detect when a user presses on display cover layer 112 to supply user input to device 10, or other suitable structure. If desired, display cover layer 112 may be attached directly to sidewall 12W with adhesive or other mounting arrangements may be used. The example of FIG. 9 is merely illustrative.

Dielectric antenna carrier 148 may be an antenna trace support structure formed from a polymer such as a liquid crystal polymer or other dielectric material. Metal traces on flexible printed circuit cable 150 may form transmission line 92. During operation, antenna signals may pass to and from the traces on carrier 148 through transmission line 92.

Antenna carrier 148 may be secured within groove 116 in display cover layer 112 without using adhesive (as an example). During assembly, carrier 148 may be mounted to housing 12 using screws 162. Following attachment of carrier 148, layer 112 may be attached to housing 12 so that carrier 148 protrudes into groove 116 and is therefore mounted within groove 116 without need for adhesive. Opaque masking layer 146 (e.g., black ink) may cover the inner surface of groove 116 to hide carrier 148 and metal traces on carrier 148 such as trace 120 from view. Metal traces on carrier 148 such as trace 120 may be formed for resonating element 122 using laser-enhanced deposition (e.g., techniques in which selected portions of the surface of structure 148 are activated by application of laser light following which metal is electrochemically deposited on the active regions) or using other deposition and patterning techniques (e.g., shadow masks and evaporation, physical or chemical vapor deposition followed by selected laser ablation or etching, etc.).

An antenna support structure such as carrier 148 may have an elongated shape extending along a longitudinal axis (into the page in the example of FIG. 9). The longitudinal axis of antenna trace support structure 148 may be aligned with the longitudinal axis of groove 116.

Figure 10:
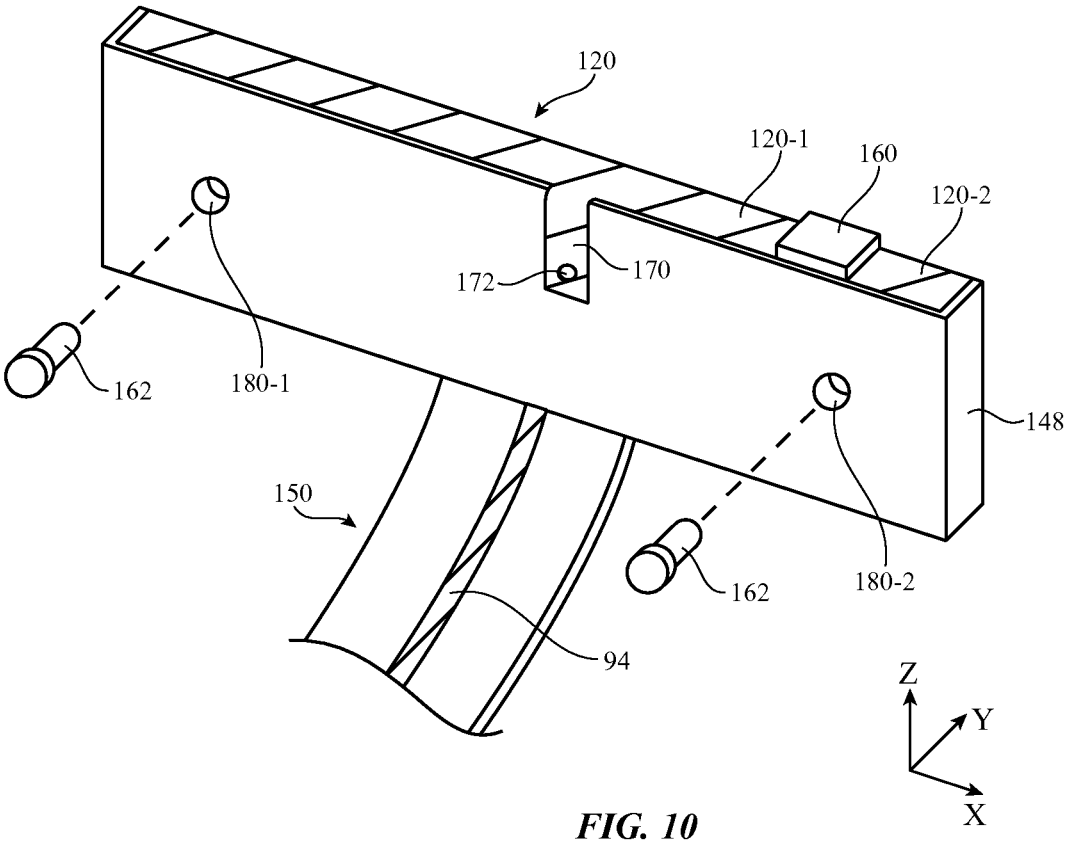
FIG. 10 is a front perspective view of an illustrative antenna resonating element and associated flexible printed circuit and antenna feed structures in accordance with an embodiment.

FIG. 10 is a front perspective view of an illustrative dielectric antenna carrier structure for forming antenna 40. Antenna carrier 148 of FIG. 10 has a rectangular shape, but, in general, antenna carrier 148 may have any suitable shape that fits into groove 116 (e.g., shapes with curved surfaces, shapes with planar surfaces, shapes with combinations of curved and planar surfaces, etc.). The use of a rectangular box shape for carrier 148 of FIG. 10 is merely illustrative.

Figure 11:
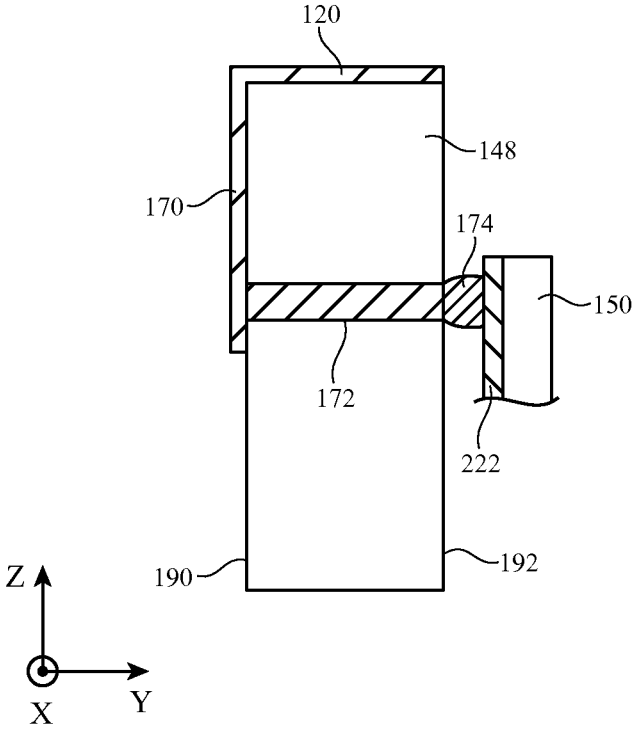
FIG. 11 is a cross-sectional side view of the illustrative antenna resonating element of FIG. 10 in accordance with an embodiment.

As shown in FIG. 10, metal traces such as antenna resonating element arm 120 may be patterned on the surface of antenna carrier 148. Arm 120 may have multiple segments such as segments 120-1 and 120-2 that are coupled to each other by a circuit component such as inductor 160. Antenna carrier 148 may have openings such as holes 180 to accommodate fasteners 162. Flexible printed circuit 150 may have metal traces such as positive transmission line trace 94. Metal trace portion 170 may extend between metal-filled via 172 and antenna resonating element arm 120. As shown in FIG. 11, via 172 may extend between front surface 190 of carrier 148 to rear surface 192 of carrier 148 and may short portion 170 to solder 174. Solder 174 may be used to couple via 172 to trace 222 on printed circuit 150.

Figure 12:
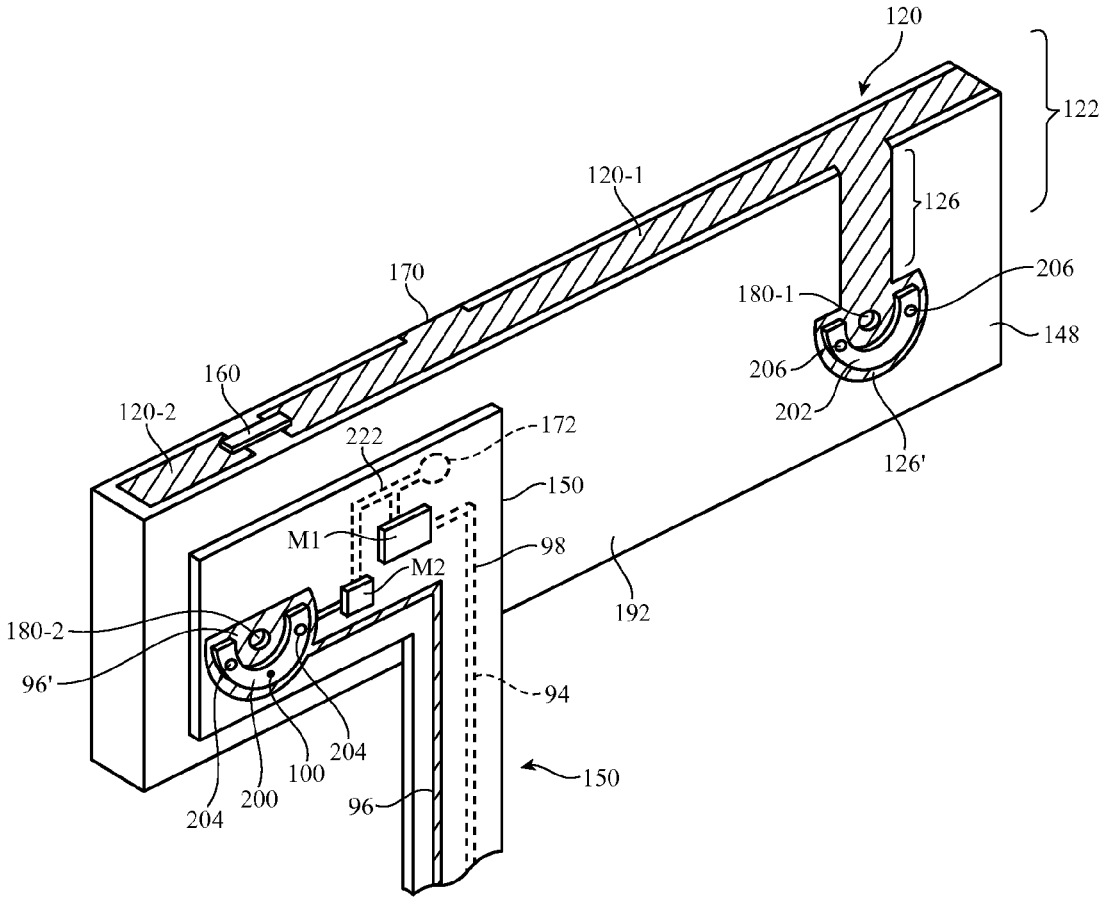
FIG. 12 is a rear perspective view of the illustrative antenna resonating element of FIG. 10 in accordance with an embodiment.

FIG. 12 is a rear perspective view of antenna carrier 148 of FIG. 10. As shown in FIG. 12, flexible printed circuit 150 may be mounted to rear surface 192 so that metal trace 222 overlaps via 172. Traces such as trace 222 couple matching circuits M1 and M2 to ground antenna feed terminal 100 and positive antenna feed terminal 98 and (through via 172 and trace 170 on the front of carrier 148) to resonating element 120. Metal trace 96' serves as part of antenna ground terminal 100 on flexible printed circuit 150 and is electrically coupled to transmission line ground path 96. Opening 180-2 may pass through carrier 148 and flexible printed circuit 150. Metal trace 96' may overlap opening 180-2. A metal grounding member such as horseshoe-shaped member 200 may be soldered to metal trace 96'. When one of fasteners 162 passes through opening 180-2 and screws into housing 12, dimples 204 on member 200 are pressed against housing 12 and help ensure that member 200 and trace 96' (and therefore path 96) are shorted to housing 12. Metal trace 126' may be electrically coupled to the ground end of return path 126. Opening 180-1 may pass through carrier 148 and printed circuit 150 (and therefore through trace 126'). A metal member such as horseshoe-shaped member 202 may be soldered to metal trace 126'. Dimples 206 on member 202 may be pressed against housing 12 when one of fasteners 162 passes through opening 180-1 and screws carrier 148 and member 202 against housing 12. The use of horseshoe shapes for members 200 and 202 helps maximize the distance between antenna ground (of which members 200 and 202 form a part) and antenna resonating element 120, thereby helping to maximize antenna bandwidth.

Because a single antenna carrier (carrier 148) supports all antenna resonating element structures for resonating element 122 and is coupled to ground (housing 12) via fasteners 162, antenna 40 can be efficiently and accurately assembled into device 10 without the need to use adhesive, springs, or mounting structures other than fasteners 162. If desired, adhesive may be placed in groove 116 to help attach antenna 40, springs may be used to couple signal traces on carrier 148 to housing 12 and/or flexible printed circuit 150, and/or additional mounting structures may be used in mounting antenna 40 within device 10.

The foregoing is merely illustrative and various modifications can be made by those skilled in the art without departing from the scope and spirit of the described embodiments. The foregoing embodiments may be implemented individually or in any combination.

What is claimed is:

1. An electronic device having opposing front and rear faces, comprising:

a metal housing with sidewalls surrounding the front face;

a display mounted in the housing;

a transparent display cover layer that covers the display and that is attached to the sidewalls of the metal housing, wherein the transparent display cover layer has an interior surface with a recess; and an antenna having an antenna resonating element on a dielectric carrier, wherein the antenna resonating element is supported by the dielectric carrier and is mounted within the recess without adhesive.

2. The electronic device defined in claim 1 wherein the dielectric carrier has at least one opening.

3. The electronic device defined in claim 2 wherein the sidewalls have at least one threaded opening and wherein the electronic device further comprises a threaded fastener that passes through the opening in the dielectric carrier into the threaded opening in the sidewalls.

4. The electronic device defined in claim 1 further comprising at least one conductive via that passes from a first surface of the dielectric carrier to a second surface of the dielectric carrier.

5. The electronic device defined in claim 4 further comprising a flexible printed circuit on which metal traces form a transmission line.

6. The electronic device defined in claim 5 wherein the flexible printed circuit has at least one metal trace that is soldered to the conductive via.

7. The electronic device defined in claim 6 further comprising at least one impedance matching circuit mounted on the flexible printed circuit.

8. The electronic device defined in claim 1 further comprising a flexible printed circuit mounted to the dielectric carrier.

9. The electronic device defined in claim 8 further comprising at least one metal member mounted to the flexible printed circuit.

10. The electronic device defined in claim 9 further comprising at least one fastener that mounts the dielectric carrier to the sidewalls so that the metal member is interposed between the flexible printed circuit and the sidewalls.

11. The electronic device defined in claim 10 wherein the metal member has at least one dimple that is pressed against the sidewalls when the fastener mounts the dielectric carrier to the sidewalls.

12. The electronic device defined in claim 1 further comprising:

a flexible printed circuit; and metal members with dimples mounted to the flexible printed circuit.

13. The electronic device defined in claim 12 further comprising:

fasteners, wherein there are openings in the dielectric carrier and the flexible printed circuit that receive the fasteners and wherein the fasteners screw into the sidewalls and press the dimples against the sidewalls.

14. The electronic device defined in claim 13 wherein at least one of the metal members comprises a horseshoe-shaped metal member.

15. The electronic device defined in claim 1 wherein the antenna resonating element and the antenna ground form an inverted-F antenna, wherein the antenna resonating element has an antenna resonating arm with first and second segments, and wherein the electronic device further comprises an inductor mounted between the first and second segments.

16. The electronic device defined in claim 15 further comprising:

a flexible printed circuit with an opening;

a metal member mounted adjacent to the opening; and a metal trace on the dielectric carrier that forms a return path for the antenna that couples the antenna resonating element to the metal member.

17. An electronic device, comprising:

a metal housing;

a dielectric layer mounted in the housing that has a groove; and an antenna having an antenna resonating element in the groove and an antenna ground that is formed at least partly from the metal housing, wherein the antenna comprises an antenna carrier, metal traces on the antenna carrier that form the antenna resonating element, and openings in the antenna carrier through which fasteners pass to attach the antenna carrier to the metal housing.

18. The electronic device defined in claim 17 further comprising:

a flexible printed circuit with openings that receive the fasteners; and metal members soldered to the flexible printed circuit adjacent to the openings, wherein the metal members are pressed against the metal housing when the antenna carrier is attached to the metal housing with the fasteners.

19. The electronic device defined in claim 18 wherein the metal members have dimples that are pressed against the metal housing.

20. The electronic device defined in claim 19 wherein the dielectric layer is a transparent display cover layer and wherein the antenna resonating element is supported in the groove without adhesive.

21. An electronic device, comprising:

a metal housing;

a display in the metal housing;

a transparent cover layer that covers the display, wherein the transparent cover layer has a recess;

a flexible printed circuit that includes a transmission line; and an antenna coupled to the flexible printed circuit, wherein the antenna has an antenna resonating element in the recess and has an antenna ground that is formed at least partly from the metal housing and at least partly from metal members on the flexible printed circuit that are pressed against the metal housing.

22. The electronic device defined in claim 21 wherein:

the metal members have dimples that are pressed against the metal housing;

the antenna comprises a dielectric antenna carrier; and the antenna resonating element comprises metal traces on the antenna carrier that form an antenna resonating element arm.

23. The electronic device defined in claim 22 further comprising a conductive via in the dielectric antenna carrier that is electrically coupled to the antenna resonating element arm.

24. The electronic device defined in claim 22 wherein the antenna resonating element arm has first and second segments and wherein the antenna includes an inductor mounted between the first and second segments.

* * * * *